US010513130B2

(12) United States Patent
Brandenberger et al.

(10) Patent No.: US 10,513,130 B2
(45) Date of Patent: Dec. 24, 2019

(54) INKJET PRINTER

(71) Applicant: Mouvent AG, Solothurn (CH)

(72) Inventors: Peter Brandenberger, Bellach (CH); Marcel Galliker, Schenkon (CH); Pierino Pierantozzi, Grenchen (CH); Walter Urech, Seengen (CH)

(73) Assignee: MOUVENT AG, Solothurn (CH)

( * ) Notice: Subject to any disclaimer, the term of this patent is extended or adjusted under 35 U.S.C. 154(b) by 0 days.

(21) Appl. No.: 15/746,616

(22) PCT Filed: Jul. 23, 2015

(86) PCT No.: PCT/CH2015/000110

§ 371 (c)(1),
(2) Date: Jan. 22, 2018

(87) PCT Pub. No.: WO2017/011925

PCT Pub. Date: Jan. 26, 2017

(65) Prior Publication Data

US 2018/0207958 A1 Jul. 26, 2018

(51) Int. Cl.

| | |
|---|---|
| ***B41J 11/00*** | (2006.01) |
| ***B41J 3/54*** | (2006.01) |
| ***D06P 5/30*** | (2006.01) |
| ***B41J 2/21*** | (2006.01) |

(Continued)

(52) U.S. Cl.

CPC ..... *B41J 11/008* (2013.01); *B41J 2/2146* (2013.01); *B41J 3/543* (2013.01); *B41J 11/0095* (2013.01); *D06P 5/30* (2013.01); *B41J 2202/08* (2013.01); *B41M 5/0047* (2013.01)

(58) Field of Classification Search

CPC ..... B41J 2/04573

See application file for complete search history.

(56) References Cited

U.S. PATENT DOCUMENTS

| | | | | |
|---|---|---|---|---|
| 5,940,105 | A * | 8/1999 | Hayami | B41J 2/01 346/139 A |
| 9,227,434 | B2 * | 1/2016 | Regelsberger | B41J 11/04 |
| 9,387,670 | B1 * | 7/2016 | Kelly, III | B41J 2/04573 |

(Continued)

*Primary Examiner* — Shelby L Fidler

(74) *Attorney, Agent, or Firm* — Birch, Stewart, Kolasch & Birch, LLP

(57) ABSTRACT

An inkjet printer comprises a transport mechanism (120) for transporting a substrate along a first axis, a print engine (160) comprising at least two inkjet print bars (165.1 . . . 8) arranged along the first axis, and a controller for controlling the ejection of ink by the at least two inkjet print bars. It further comprises at least two first encoders for the determination of at least two first positions of substrate locations along the first axis and a compensation module for processing the at least two determined first positions to generate at least one first individual compensation parameter for each of the at least two inkjet print bars (165.1 . . . 8). The first compensation parameters are transmitted to the controller to influence the ejection of ink in such a way that effects due to variations of the at least two first positions of the substrate along the first axis are compensated. The effects of positioning errors that may affect different print bars (165.1 . . . 8) arranged along the longitudinal axis of the print engine (160) differently may be compensated using the encoders, individually for the different print bars (165.1 . . . 8).

16 Claims, 6 Drawing Sheets

(51) Int. Cl.
*B41M 5/00* (2006.01)
*B41J 19/14* (2006.01)

(56) References Cited

U.S. PATENT DOCUMENTS

| | | | | |
|---|---|---|---|---|
| 2004/0115344 | A1 | 6/2004 | Newsome et al. | |
| 2005/0078133 | A1 | 4/2005 | Molinet et al. | |
| 2008/0124158 | A1* | 5/2008 | Folkins | G03G 15/0152 399/396 |
| 2013/0201237 | A1 | 8/2013 | Thomson et al. | |
| 2013/0342621 | A1* | 12/2013 | Webster-Curley | B41M 7/0081 347/102 |
| 2015/0321488 | A1* | 11/2015 | Ohnishi | B41J 11/002 347/102 |

* cited by examiner

INKJET PRINTER

TECHNICAL FIELD

The invention relates to an inkjet printer comprising a transport mechanism for transporting a substrate along a first axis, a print engine comprising at least two inkjet print bars arranged along a longitudinal axis of the print engine and a controller for controlling the ejection of ink by the at least two inkjet print bars.

BACKGROUND ART

Inkjet printers typically include one or a plurality of inkjet print heads, each including an array of nozzles formed on a nozzle face. The nozzles eject ink drops, the ink being provided from an ink supply through an ink path. Ink drop ejection may be controlled by suitable actuators such as piezoelectric transducers. In so-called "drop-on-demand" inkjet printers, each actuator may be selectively fired to eject a drop at a specific location on a substrate. The print heads and the substrate may be moved relatively to each other during the printing operation. In particular, the substrate may be moved stepwise along a first direction, whereas the inkjet print heads are scanned continuously along a second direction, which may be perpendicular to the first direction.

For high throughput, many inkjet printers comprise a plurality of inkjet print heads. Each print head is part of an inkjet print module. In addition to the print head, such a module features further components for the feeding and conditioning of ink, for controlling the ejection of the ink by the print head and/or for mechanical or thermal purposes. A plurality of such modules are mounted to a mounting assembly, in an adjoining relationship along a longitudinal direction of the mounting assembly, i. e. a so-called "print bar" is created. The nozzle arrays of adjacent print heads may be arranged in such a way that seamless printing over the width of a plurality of inkjet print heads is possible, i. e. the nozzle array of the entire print bar is created by a plurality of inkjet print heads but still continuous with a uniform arrangement of nozzles over the whole array.

In order to print large areas, for example in textile printing, a number of print bars may be attached to a mechanical unit, the print bars and the mechanical unit forming a print engine. The entire engine is movable with respect to the substrate. In particular, each of the print bars is dedicated to produce ink dots on the substrate having a certain colour, i.e. inks of different colours (such as cyan, magenta, yellow and black) are supplied to different print bars. The image will be the combination of dots produced by different print bars during different scans of the print engine. It is crucial that the positions of the dots of different scans exactly match in order to avoid distortions of the image or colour defects.

Furthermore, the image is constituted by a number of bands created in different scans of the print engine. Even minute inaccuracies may lead to visible "stitches" at the transition from one band to the next one.

Known inkjet printers comprising a print engine having a plurality of print bars suffer from positioning inaccuracies and therefore are prone to image defects as mentioned before.

SUMMARY OF THE INVENTION

It is the object of the invention to create an inkjet printer pertaining to the technical field initially mentioned, that exhibits reduced susceptibility to image defects.

The solution of the invention is specified by the features of claim 1. According to the invention, the inkjet printer comprises at least two first encoders for the determination of at least two first positions of substrate locations arranged along the first axis. The inkjet printer further comprises a compensation module for processing the at least two determined first positions to generate at least one first individual compensation parameter for each of the at least two inkjet print bars. The first compensation parameters are transmitted to the controller to influence the ejection of ink in such a way that effects due to variations of the at least two first positions of the substrate along the first axis are compensated.

One source of image errors are slight offsets in the position of the substrate, e. g. due to a slight change in tension of a substrate having elastic properties or due to minute bulging of the substrate. Corresponding image errors may be avoided by employing the first encoders. The invention allows for compensating the influence of variations of the substrate positions with respect to at least two print bars having a different position with respect to the first axis. The compensation ensures that all portions of the image to be printed onto the substrate are in register, i. e. in particular that there are no overlaps or voids with respect to the printed image.

Each of the inkjet print bars comprises one or several inkjet print heads, in particular drop-on-demand inkjet print heads. The print heads are arranged on the print bar in a linear row or in a staggered pattern, i. e. along two or more linear rows. In the first case, the longitudinal axis of the print engine runs along the linear row, in the second case, the longitudinal axis is parallel to the linear rows and constitutes generally a centre line or a symmetry axis of the print bar pattern of the print engine.

Basically, two configurations of the print engine are discussed in the following. In a first configuration, the longitudinal extension of a number of print bars (in particular of all the print bars) extends along a common axis which is parallel to the first axis. In a second configuration, there are several groups of print bars, the longitudinal extensions of the print bars extending perpendicular to the first axis, each group covering the width of the print area and the different groups (e. g. relating to different colors) being arranged at different positions along the first axis. In both configurations, different print bars have different positions along the first axis due to the longitudinal extension of the print engine and/or the arrangement of print bars in different positions along the first axis, e. g. if the inkjet printer comprises a number of print bars that cover the entire width of the substrate and that are arranged in parallel to each other, separated by a distance along the first axis.

The term "encoder" is not limited to a physical component. It encompasses "virtual" encoders that are provided by a combination of hardware components (such as sensors) and software. Nevertheless, an encoder will provide positional information with respect to a certain axis and a certain measuring position.

The at least two locations the positions of which are determined using the encoders, are arranged along the first axis. As an example, the two positions may be arranged near the two ends of the print area. Optionally, further encoders are arranged in between.

In particular, the inkjet printer according to the invention is suitable for printing on large area substrates such as textiles. If high throughput shall be achieved, the print engine, i. e. the component including all print bars, will usually be fairly large, i. e. its extensions, such as the extension along the first axis, will be large. This means that variations of the substrate locations along this extension may be substantial and lead to distortions of the printed image if they are not compensated. These distortions may affect the printed image differently, depending on the position of the respective print bar. Therefore, according to the invention, the distortions are individually compensated print bar by print bar.

Preferably, each print bar of the total number of print bars will be assigned an individual compensation parameter. Nevertheless, it is in the scope of the invention to group two or more print bars and to assign the same compensation value to all the print bars of the group.

The compensation module may be embodied in hardware, in software or in a combination of hardware and software. The output of the compensation module will be connected to an input of the controller in order to transmit the compensation parameters. In principle, these parameters may be transmitted through usual data buses. However, it should be ensured that the time needed for the determination of the positions, for the generation of the parameters by the compensation module, the transmission to the controller and the processing by the controller should be substantially smaller than the usual time scale of changes of the positional errors to be compensated, i. e. the compensation should be effected in "real-time".

The invention is of particular advantage in the context of inkjet printers having at least three inkjet print bars arranged at different positions along the first axis. These printers allow for high throughput but are particularly prone to positional errors of the print bars due to the considerable extension of the print engine.

Nevertheless, the invention is in principle also applicable to inkjet printers having only two print bars.

In a preferred embodiment, the transport mechanism for transporting the substrate comprises a plurality of rollers supporting the substrate, and the at least two first encoders are assigned to at least two of the rollers. The encoders may comprise sensors for sensing the rotational position of these rollers and/or cameras that record the printed image (or pre-existing structures) on the substrate at the position of the rollers.

As an alternative or in addition, the inkjet printer may comprise first encoders that are independent from the rollers, or the support of the substrate is effected without rollers altogether.

Preferably, the at least two rollers have a different circumference. When using encoders that sense the rotational position (or velocity) of the rollers, this allows for distinguishing between effects originating at the different rollers during processing. The corresponding additional information allows for a more precise compensation. In the most simple case, the cross-section of the rollers is circular, and the different circumference is achieved by choosing different diameters for the at least two rollers.

The compensation module may be programmed to apply an interpolation to the determined first positions in order to generate the first compensation parameters. In a simple case, the compensation parameter for a certain print bar may be calculated from positions determined by the two encoders closest to the respective print bar. The distances to the two encoders may be taken into account to calculate a weighted average from the two positions. Similarly, three or more positions may be taken into account.

In another approach, the positions determined by the plurality of encoders will be employed for calculating the parameters of a parameterization of the positions of the print bars.

Alternatively, there is no interpolation. This may be a suitable solution e. g. if a single encoder is assigned to each of the print bars, such that a compensation parameter for a specific print bar may be generated from the position determined by the assigned encoder.

In a first preferred embodiment, the longitudinal extension of the at least two inkjet print bars of the print engine extends parallel to the first axis, and the inkjet printer comprises a scanning mechanism for moving the print engine along a second axis perpendicular to the first axis. This means that the longitudinal axis of the print engine is meant to be parallel to the axis of transporting the substrate (the feed axis). The second axis (the scanning axis) is perpendicular to the longitudinal axis of the print engine. In a given scan of the print engine, the print bars will therefore operate on different regions of the substrate. It has turned out that this layout allows for a considerable reduction of the time required for reversing the scanning direction, thereby considerably increasing the printing speed. Furthermore, the footprint of the printer in a direction perpendicular to the first axis may be reduced.

Preferably, the inkjet printer according to the first preferred embodiment further comprises at least two second encoders for the determination of at least two second positions of the at least two inkjet print bars along the second axis, wherein the compensation module is programmed to process the second positions to generate at least one second individual compensation parameter for each of the at least two inkjet print bars and wherein the second compensation parameters are transmitted to the controller to influence the ejection of ink in such a way that effects due to differences of the at least two second positions from predetermined reference positions are compensated.

Due to play or inaccurate adjustment, the axis defined by the longitudinal extension of the at least two inkjet print bars may be slightly inclined to the first axis, and there may be an angle that goes up to 0.5°. Especially at print engines having a considerable extension along the first axis, small inaccuracies of the orientation of the print engine, i. e. small inclinations of the longitudinal axis with respect to the first axis, lead to fairly large absolute errors in the position of the ink dots created on the substrate, along the second axis. These errors usually affect different print bars arranged along the longitudinal axis of the print engine differently. One solution would be to make the construction of the printer, in particular of the print engine, stiffer. However, this usually means a considerable increase of weight. Using the second encoders according to the invention, the effects of these inaccuracies may be compensated, individually for the different print bars, without having an increased weight, in particular with respect to the print engine which has to be dynamically moved during the printing process.

The at least two second encoders may be embodied in different ways. Options are the use of linear encoders or interferometers.

Again, the compensation module may be programmed to apply an interpolation to the determined second positions in order to generate the second compensation parameters. In a simple case, the compensation parameter for a certain print bar may be calculated from positions determined by the two encoders closest to the respective print bar at the time of measuring. The distances to the two encoders may be taken into account to calculate a weighted average from the two positions. Similarly, three or more positions may be taken into account.

In another approach, the positions determined by the plurality of encoders will be employed for calculating the parameters of a parameterization of the positions of the print bars.

Alternatively, there is no interpolation. This may be a suitable solution e. g. if always a single encoder may be assigned to each of the print bars, such that a compensation parameter for a specific print bar may be generated from the position determined by the assigned encoder.

In particular, the first compensation parameters are spatial offset values and the controller selects ejection nozzles of the print bars to be used according to the spatial offset values. In particular, the nozzle arrays of the print bars comprise an active region including the majority of the nozzles and an inactive region including the rest of the nozzles. The position of the active region may be shifted by software along the longitudinal axis of the nozzle array. This allows for compensating the positional error of the print bar with respect to the substrate, along the longitudinal axis.

In particular, the second compensation values are temporal offset values and the controller time shifts ejection of ink of one or several of the print bars according to the temporal offset values. The time shift affects the ink dot position during the scanning motion of the print engine and thus the print bars. By assigning suitable time shifts, the effect of an inclination of the print engine with respect to a reference axis that is perpendicular to the scanning axis may be compensated.

In a second preferred embodiment, a longitudinal extension of the at least two inkjet print bars of the print engine extends parallel to a second axis perpendicular to the first axis. Particularly, the inkjet print bars are arranged in such a way that the entire width of the print area (along the second axis) is covered by the print bars, such that essentially the entire substrate may be covered during continuous movement of the substrate, in a single pass. This leads to a high throughput and avoids scanning the print engine along the second axis.

In the context of this second embodiment, preferably, the first compensation values are temporal offset values, and the controller time shifts ejection of ink of one or several of the print bars according to the temporal offset values.

An advantageous inkjet printer comprises a) a transport mechanism for transporting a substrate along a first axis;

b) a print engine comprising at least two inkjet print bars arranged along a longitudinal axis of the print engine;

c) a scanning mechanism for moving the print engine along a second axis, the second axis being oriented perpendicular to the first axis;

d) a controller for controlling the ejection of ink by the at least two inkjet print bars; and the longitudinal axis of the print engine runs parallel to the first axis.

In a given scan of the print engine, the print bars will therefore operate on different regions of the substrate. It has turned out that this layout allows a considerable reduction of the time required for reversing the scanning direction, thereby considerably increasing the printing speed. Furthermore, the footprint of the printer in a direction perpendicular to the first axis may be reduced.

Preferably, in the context of such an inkjet printer each of the inkjet print bars comprises an ink nozzle array, a main extension of which extends along the longitudinal axis. The nozzle array of the print bar may be formed by nozzle arrays of a plurality of inkjet print heads. These nozzle arrays may be arranged in such a way that they form a continuous uniform pattern of nozzles. Preferably, the ink nozzle array of a print bar is a two-dimensional arrangement of ink nozzles, having a certain length (in the main extension) and a certain width (perpendicular to the main extension), wherein the width is smaller than the length. Preferably, all ink nozzles of the ink array of the print bar are supplied with the same ink, i. e. the print bar will create ink dots of a single colour.

In a preferable embodiment, the main extension of the nozzle array has a length l. The inkjet print bars are arranged on the print engine in such a way that a longitudinal distance d between a start of the nozzle array of a first inkjet print bar and a start of a nozzle array of a second inkjet print bar, adjacent to the first inkjet print bar, is larger than the length l of the nozzle array. The controller is programmed to control the transport mechanism to effect a main transport feed of length l between scans of subsequent bands. It is to be noted that the length l relates to the active region of the nozzle array only, if not all nozzles of the nozzle array are employed for printing in a certain scan. If integer multiples of l are avoided for d, this layout has the effect that the transitions between neighbouring bands (created in different scans) will be at different positions for different colours. Clearly visible stitches are thus avoided.

Advantageously, $d=l+x$, where $x=(m/n)\,l$, where n is the number of inkjet print bars and m is an integer number, where $1<m<n$. This ensures that the transitions between neighbouring bands of the different colours are evenly distributed in the printed surface. At the same time, a compact design of the print engine is rendered possible, where the value of m may be chosen in order to optimize the design with respect to the space required for the print bars and a minimum longitudinal extension.

Preferably, the transport mechanism comprises a plurality of rollers supporting the substrate. This allows for reliably supporting and transporting the substrate. As mentioned before, the rollers may be further used for detecting the local position of the substrate.

Advantageously, an adhesive belt for attaching the substrate is supported on the plurality of rollers. Prior to reaching the rollers, the substrate is pressed onto the adhesive belt, after passing the printer, the substrate is separated from the belt. Adhering the substrate to the belt allows for reliable and essentially tension-free transport of the substrate.

Preferably, the plurality of rollers is provided with a cooling mechanism. This allows for reliably controlling the temperature of the substrate supported on the rollers. Thereby, inaccuracies caused by temperature differences may be minimized. The cooling mechanism is in particular a fluid cooling mechanism such as a water cooling mechanism.

A particularly preferred embodiment of the invention is an inkjet printer comprising a) a transport mechanism for transporting a substrate along a first axis;

b) a print engine comprising at least four inkjet print bars for printing at least four different colours arranged along a longitudinal axis of the print engine, where this longitudinal axis runs parallel to the first axis and where each of the inkjet print bars comprises an ink nozzle array, a main extension of which extending along the longitudinal axis;

c) a scanning mechanism for moving the print engine along a second axis, the second axis being oriented perpendicular to the first axis;

d) a controller for controlling the ejection of ink by the at least two inkjet print bars;

e) at least two first encoders for the determination of at least two first positions of locations arranged along the longitudinal axis of the print engine relative to the first axis;

f) a compensation module for processing the determined first positions to generate at least one first individual compensation parameter for each of the at least two inkjet print bars, wherein the first compensation parameters are transmitted to the controller to influence the ejection of ink in such a way that effects due to differences of the at least two first positions relative to the reference axis are compensated.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

Preferred Embodiments

Figure 1:
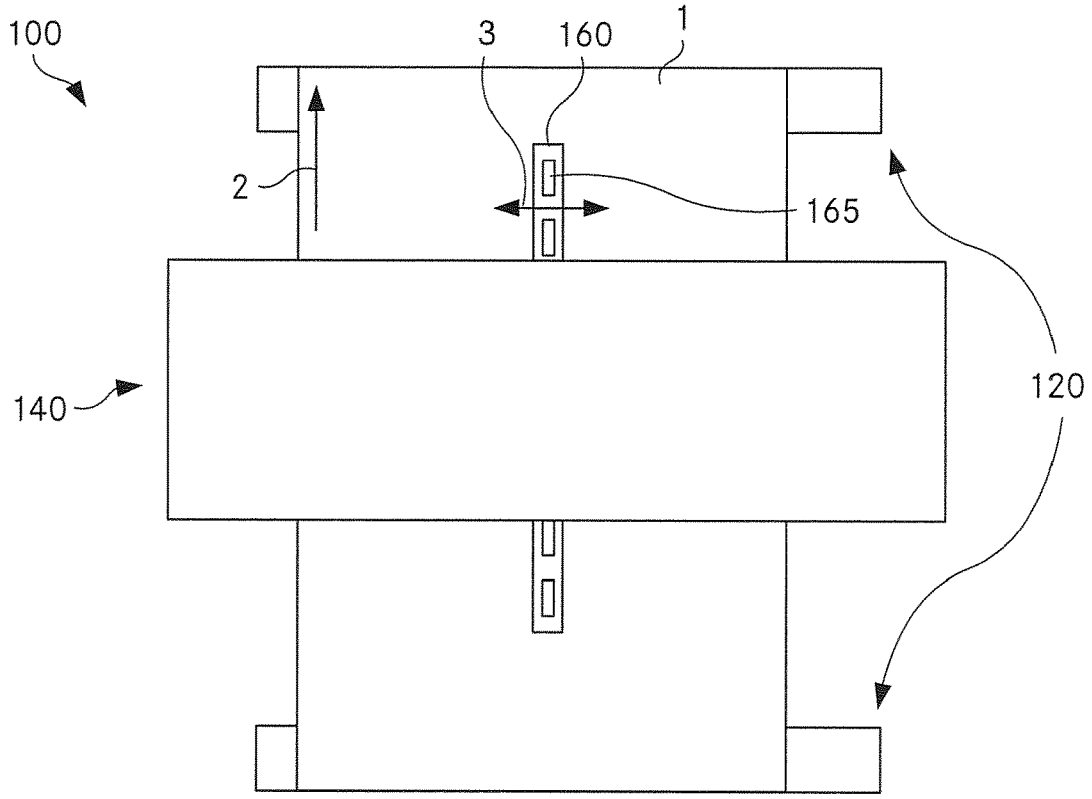
FIG. 1 A schematic representation of a first basic layout of an inkjet printer according to the invention.

The FIG. 1 is a schematic representation of a first basic layout of an inkjet printer according to the invention. The inkjet printer 100 comprises a transport mechanism 120 for transporting a substrate 1 along a main transport direction 2. It further comprises a scanning mechanism 140 for moving a print engine 160 along a scanning axis 3. The scanning axis 3 is perpendicular to the main transport direction 2. The print engine 160 comprises 8 print bars 165 arranged in a row, the row as well as the main extension of the print bars 165 being parallel to the main transport direction 2. In a given scan, each of the print bars 165 will act onto another region of the substrate 1.

Figure 2:
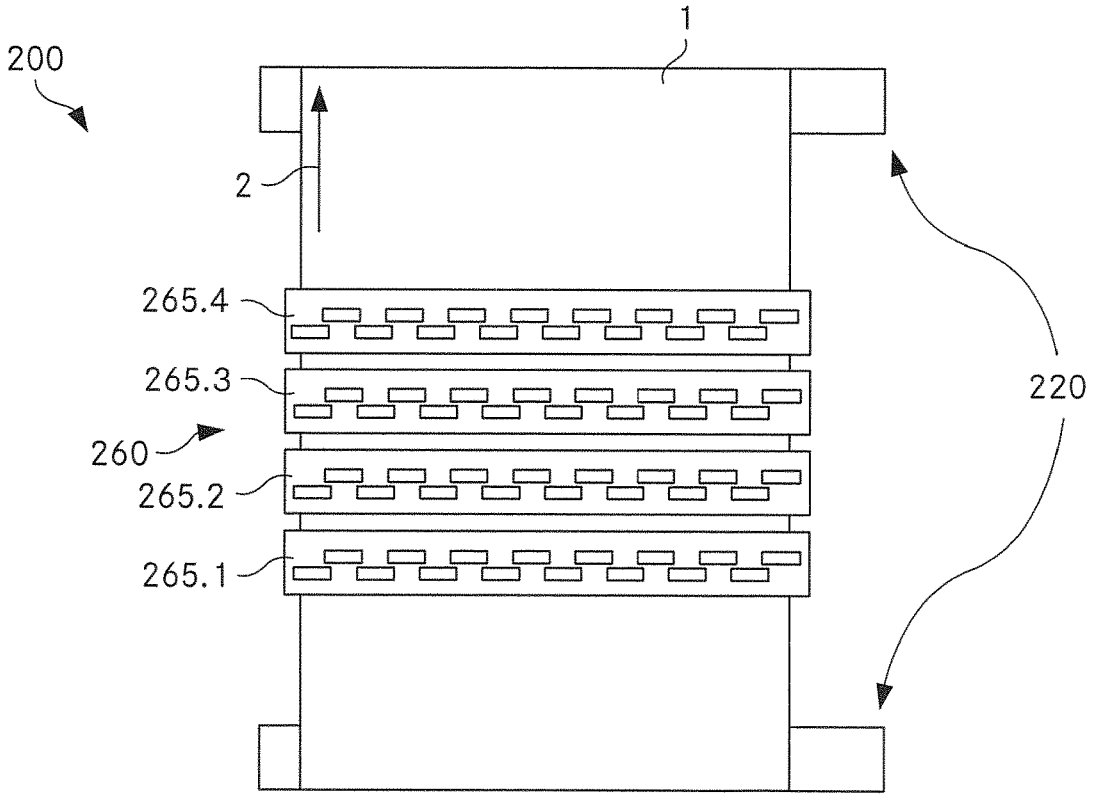
FIG. 2 a schematic representation of a second basic layout of an inkjet printer according to the invention.

The FIG. 2 is a schematic representation of a second basic layout of an inkjet printer according to the invention. The inkjet printer 200 comprises a transport mechanism 220 for transporting a substrate 1 along a main transport direction 2. It further comprises a print engine 260 comprising four print bars 265.1, 265.2, 265.3, 265.4 extending in a direction perpendicular to the main transport direction 2 and covering the entire width of the substrate 1. Every print bar 265.1 . . . 4 comprises a number of inkjet print heads, arranged in a staggered pattern, in a manner known as such. The inkjet print heads cover the entire width of the substrate 1 to be printed on.

A specific embodiment of an inkjet printer according to the invention is described in connection with FIGS. 3-7. This inkjet printer follows the first basic layout as shown in FIG. 1.

Figure 3:
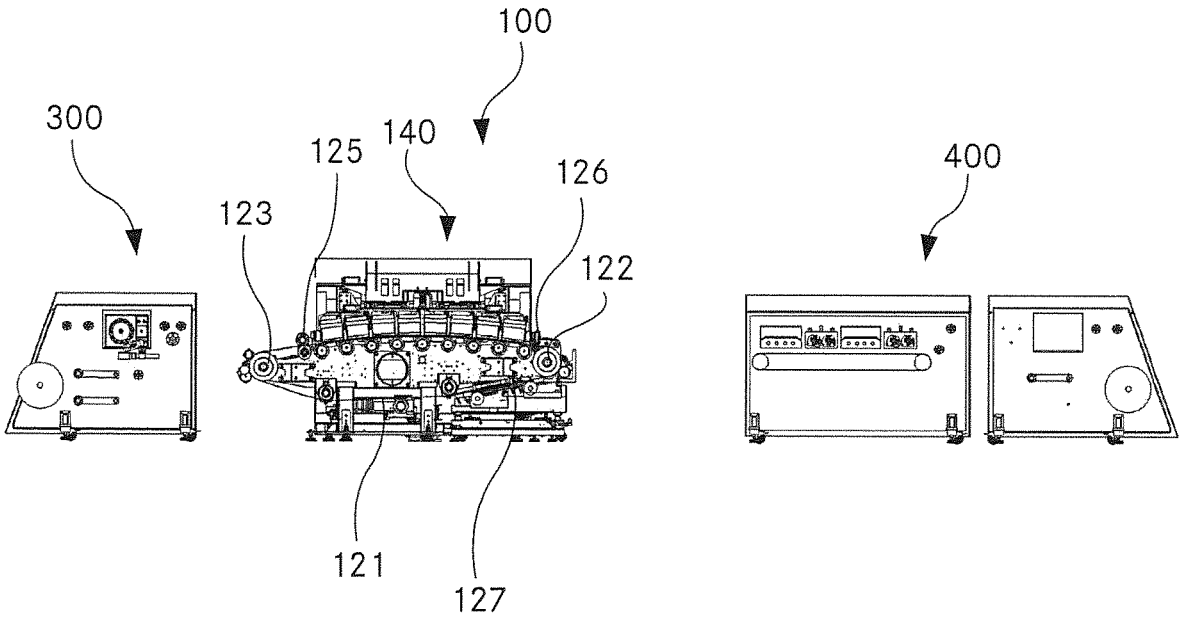
FIG. 3 a side view of an inkjet printer according to the invention including upstream and downstream stations.
Figure 4:
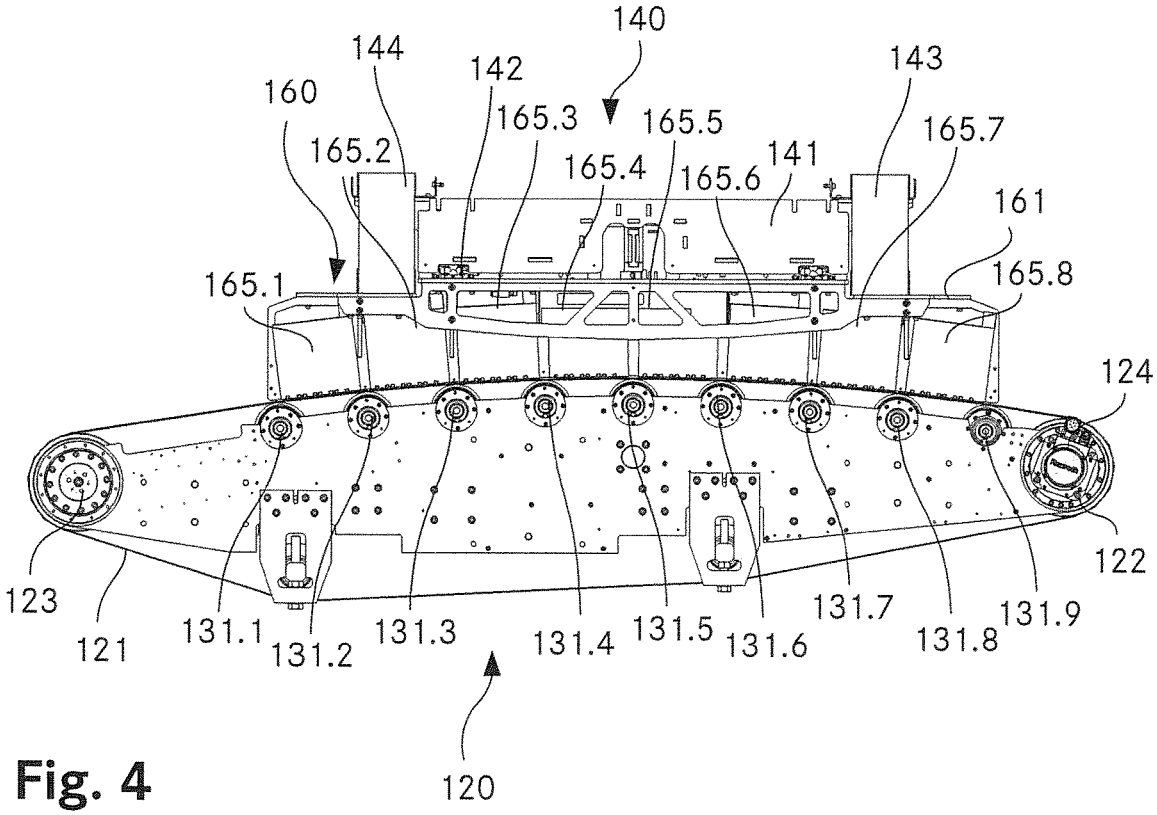
FIG. 4 a side view of the transport mechanism, the scanning mechanism and the print engine of the inkjet printer.
Figure 5:
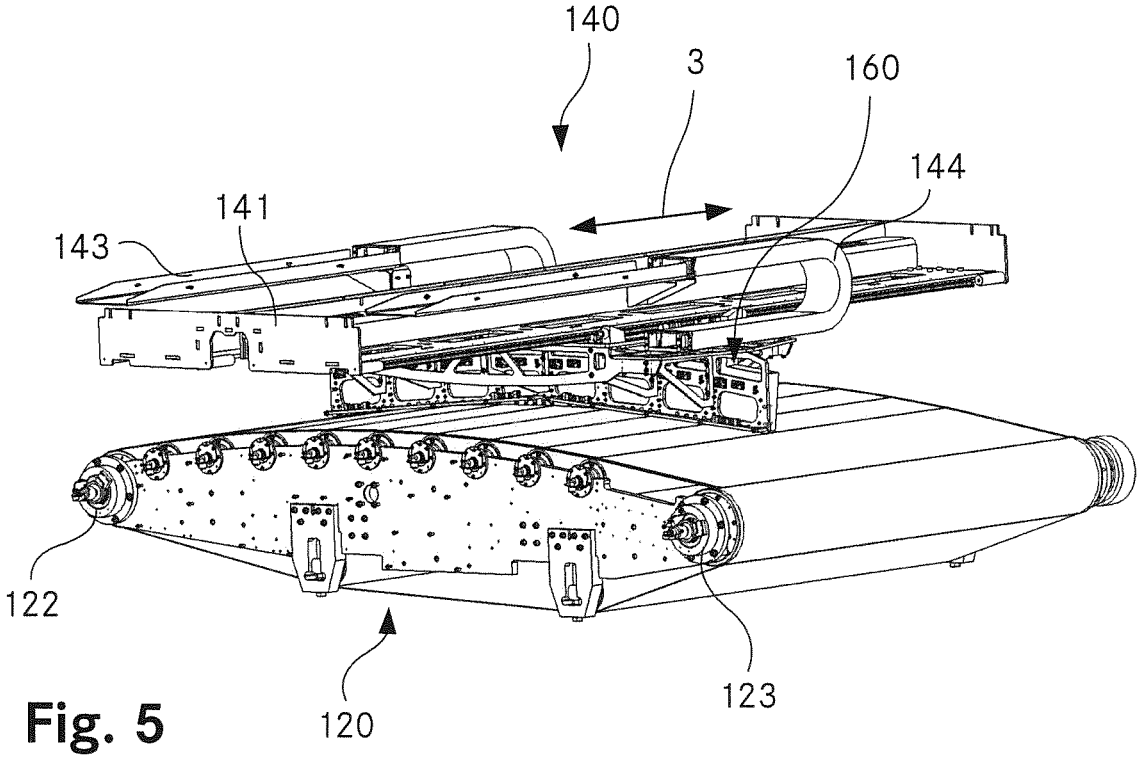
FIG. 5 an oblique view of the inkjet printer.
Figure 6:
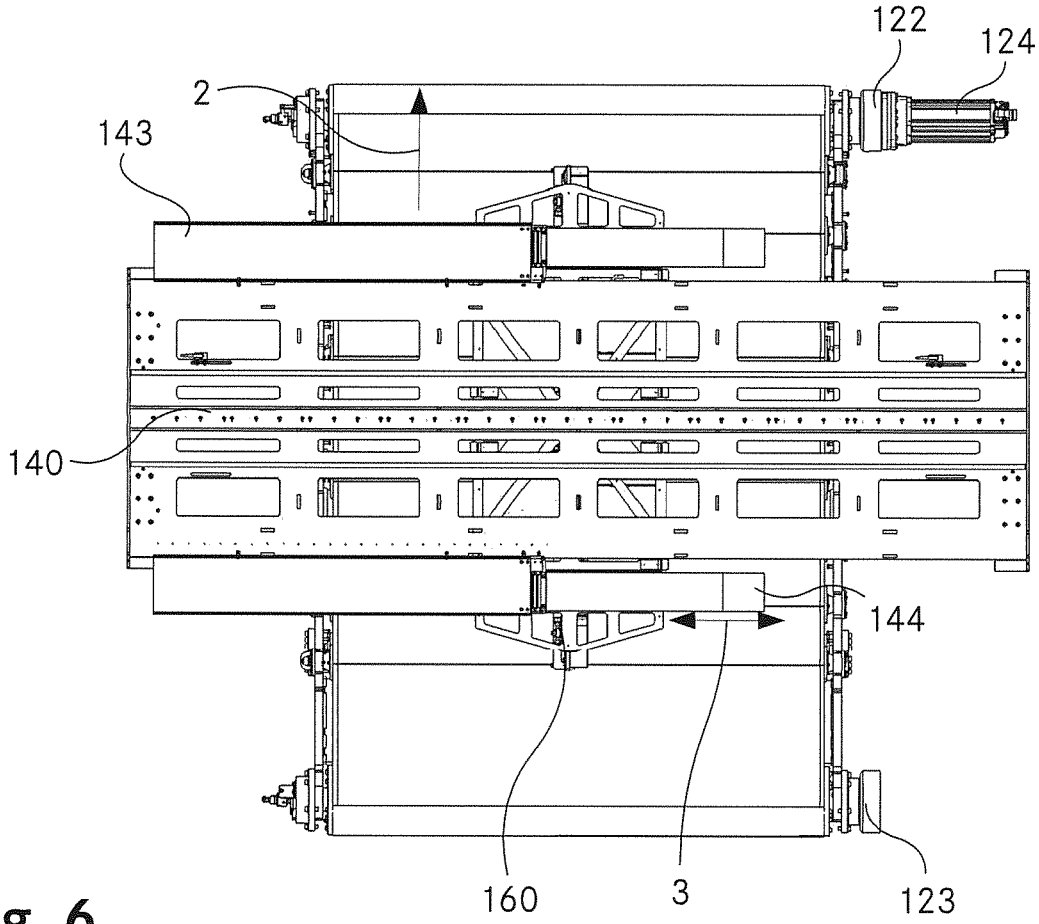
FIG. 6 a top view of the inkjet printer.
Figure 7:
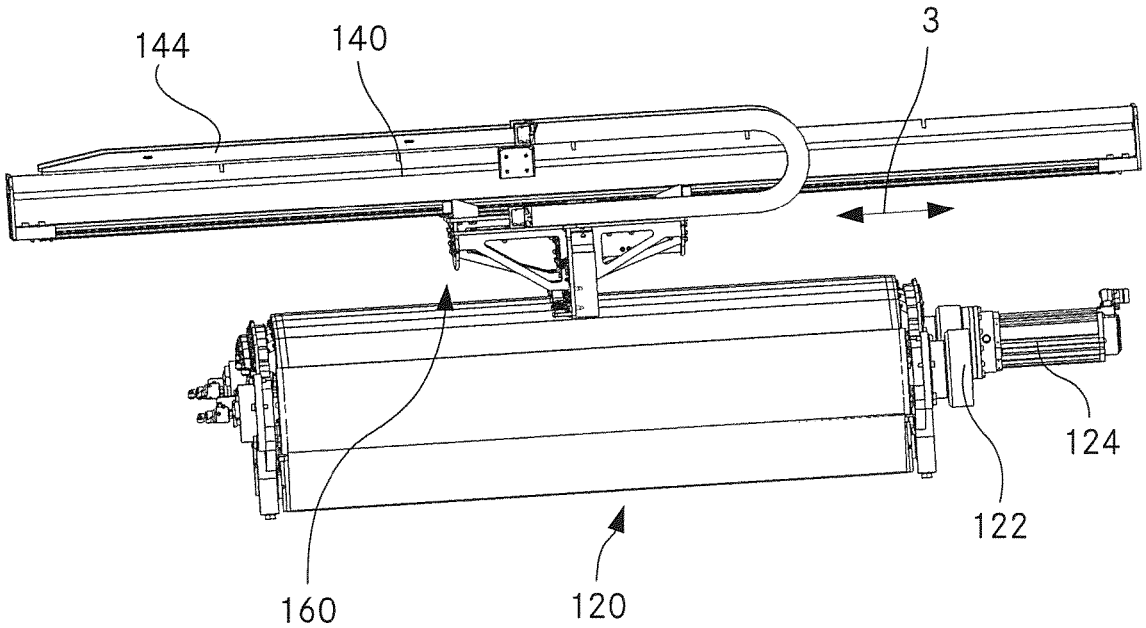
FIG. 7 a front view of the inkjet printer.

The FIG. 3 is a side view of an inkjet printer according to the invention including upstream and downstream stations. The FIG. 4 is a side view of the transport mechanism, the scanning mechanism and the print engine of the inkjet printer. The FIG. 5 is an oblique view of the inkjet printer, the FIG. 6 a top view and the FIG. 7 a front view.

The inkjet printer 100 is arranged in a printing line, in between a feeder 300 for unwinding and tensioning the textile substrate and a drying station 400 for drying the printed substrate. The inkjet printer 100 comprises a supporting belt 121, running around two main rollers 122, 123, one of the rollers 122 being provided with a servo drive motor 124. The supporting belt 121 is tensioned by appropriate tensioning rollers. The top surface of the transport mechanism 120, cooperating with the print engine 160, is formed by 9 support rollers 131.1 . . . 131.9. They are arranged such that they form an arc-shaped surface, a first support roller 131.1 is arranged in a position facing the leading end of a first of the print bars 165.1 of the print engine 160, a last support roller 131.9 is arranged in a position facing the trailing end of a last of the print bars 165.8, and the further support rollers 131.2 . . . 8 are arranged in positions facing a gap between adjacent print bars 165.1 . . . 8.

The substrate is adhered to the supporting belt 121 by a suitable adhesive and an application of pressing force by an attaching device 125 in the region of the roller 123 on the infeed side, and it is separated again from the supporting belt 121 by a separating device 126 in the region of the roller 122 on the discharge side. The belt is cleaned, in particular freed from residual adhesive by a cleaning device 127 arranged essentially below the roller 122 on the discharge side.

The roller 123 on the infeed side, adjacent to the feeder 300 as arranged at a height lower than the roller 122 on the discharge side, adjacent to the drying station 400. This allows for directly feeding the substrate to the drying station 400 at an appropriate height and feed angle.

The inkjet printer 100 further comprises a scanning mechanism 140 comprising a main support 141 provided by a linear guide mechanism 142 for supporting the print engine 160 and driven by a linear drive known as such. The linear guide 142 comprises three parallel rails attached to the main support 141 cooperating with three parallel roller bearing mechanisms. This allows for moving the print engine 160 along a scanning axis 3. On both sides of the main support 141 a cable chain 143, 144 is provided comprising ink and water lines as well as power and network cables for supplying and controlling the print bars of the print engine 160.

The print engine 160 comprises a main frame 161 which extends along the longitudinal direction of the print engine 160 and to which the three roller bearing mechanisms are fixedly attached. The main frame 161 includes a lattice-like flat structure defining an essentially vertical plane. To one side of the structure, the print bars 165.1 . . . 165.8 are attached (cf. FIG. 5).

Each of the print bars 165.1 . . . 8 comprises 4 drop-on-demand inkjet print modules, each module comprising an inkjet print head.

In a manner known as such, the bottom surfaces of the print heads as well as the respective nozzle arrays are both rhomboid shaped, the nozzle arrays being slightly slanted with respect to the longitudinal axis of the print bar. This allows for having a seamless transition between the two adjoining modules. Accordingly, a continuous uniform ink nozzle array is formed, the usable width (perpendicular to the longitudinal axis of the print bar) being 40.6 mm (2048 nozzles, 1200 dpi), the usable length being 173.4 mm (8192 nozzles, 1200 dpi). The print engine 160 has a total length of 1400 mm, a width of 100 mm and a height of 300 mm.

Figure 8:
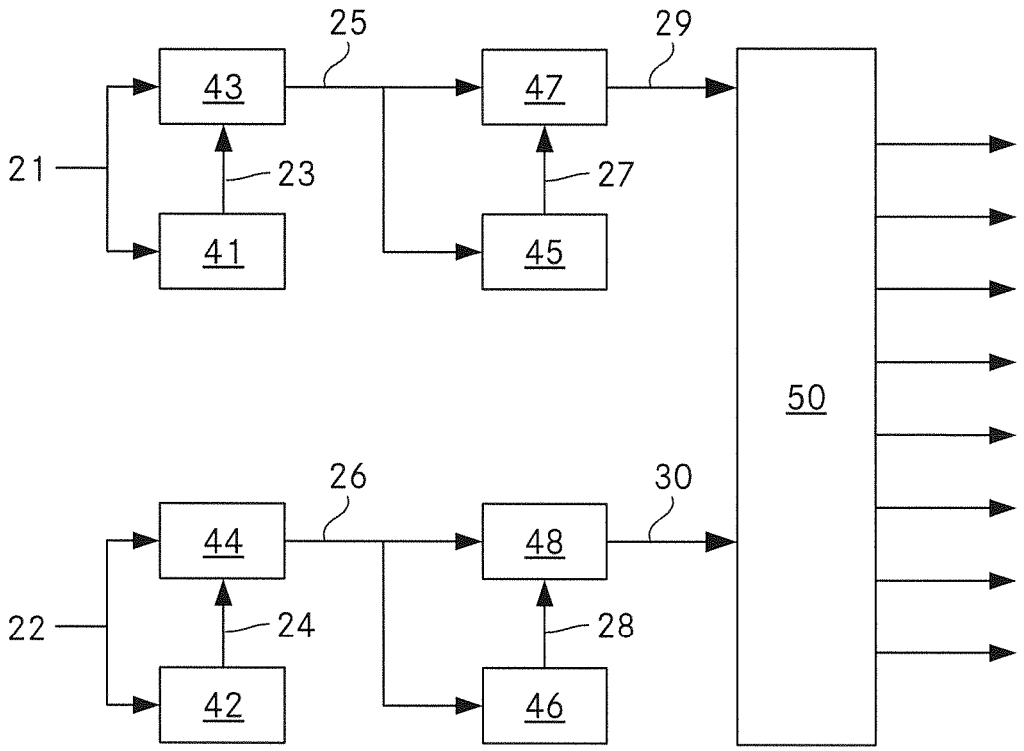
FIG. 8 a block diagram illustrating the compensation of variations of the substrate position.

The compensation of variations of the substrate position along the main transport direction 2 is described in the following. It is schematically shown in the block diagram of FIG. 8. The basis for the compensation are values obtained from encoders linked to the two rollers 122, 123, i. e. a first encoder value 21 obtained from roller 122 and a second encoder value 22 obtained from roller 123. First, a time series of measurements of encoder values 21, 22 is filtered by a median filter. Correction values are obtained by determination of the difference between the filtered measurements and a straight reference line (encoder step analysis 41, 42). The reference line is obtained from a least-square fit with respect to the filtered measurements. The correction values are dependent from the velocity. Therefore, in a next step, the correction values are compensated by the respective velocity to obtain velocity-independent correction values 23, 24. These values 23, 24 are stored and will be subsequently used during operation of the printer in an encoder step correction 43, 44. Each revolution of the rollers yields further correction values. They are continuously employed to refine the stored correction values 23, 24.

The corrected encoder measurements 25, 26 are filtered by an adaptive notch filter. Again, the coefficients of the filter are determined revolution by revolution and continuously updated. The input of the adaptive notch filter (i. e. a cosine and a sine period) does not change for the different revolutions of the respective roller, accordingly, the adaptive notch filter may be implemented by a simple multiply-add structure. The concentricity analysis 45, 46 yields correction values 27, 28 being a sine period with a certain phase and amplitude. Averaging of the coefficients stabilizes the phase of this correction sine. The correction values 27, 28 are stored and will be subsequently used during operation of the printer in a concentricity correction 47, 48.

The corrected encoder values 29, 30 are fed to the final elongation correction 50. In this stage of the process, the corrected values 30 of encoder 2 are interpolated for obtaining encoder values relating to the same points in time as the corrected values 29 of encoder 1. Furthermore, due to the fact that the roller diameters are not equal, the interpolated values of encoder 2 will be compensated by the ratio of the roller diameters.

The distance between the rollers as well as between roller 1 and the individual print bars is known. For each point in time relating to a value obtained by encoder 1 and for each of the print bars, the difference between the encoder value relating to encoder 2 and the encoder value relating to encoder 1 is compensated by the ratio of the distances. The result is subtracted from the encoder value obtained from encoder 1 thus correcting encoder 1. This amounts to obtaining the dynamics of encoder 1 it would exhibit directly below the respective print bar. In other words, "virtual" encoders having a roller diameter 0 and being positioned directly below the print bars are calculated.

The same procedure is applied to encoder 2. The virtual encoders relating to print bars that lie closer to encoder 1 are calculated on the basis of encoder 1, whereas the virtual encoders relating to print bars that lie closer to encoder 2 are calculated on the basis of encoder 2. The compensation is applied in that the region of nozzles of the respective print bar that is actually used to produce the respective part of the image is suitably shifted, according to the respective compensation parameter.

In a similar way, variations of the angular position of the print engine 160 may be compensated. The encoder values are obtained from linear encoders each measuring the position of a location along the print engine 160 with respect to the second axis. The processing steps to obtain the individual compensation parameters for the print bars essentially correspond to those described before. In contrast however, for the compensation the ejection of ink by the respective print bar is delayed using a time-variable and distance-constant, velocity-dependent delay, which allows for applying the corrections into the future as well as into the past.

This is also the kind of compensation that is applied in the case of a configuration as shown in FIG. 2.

Figure 9:
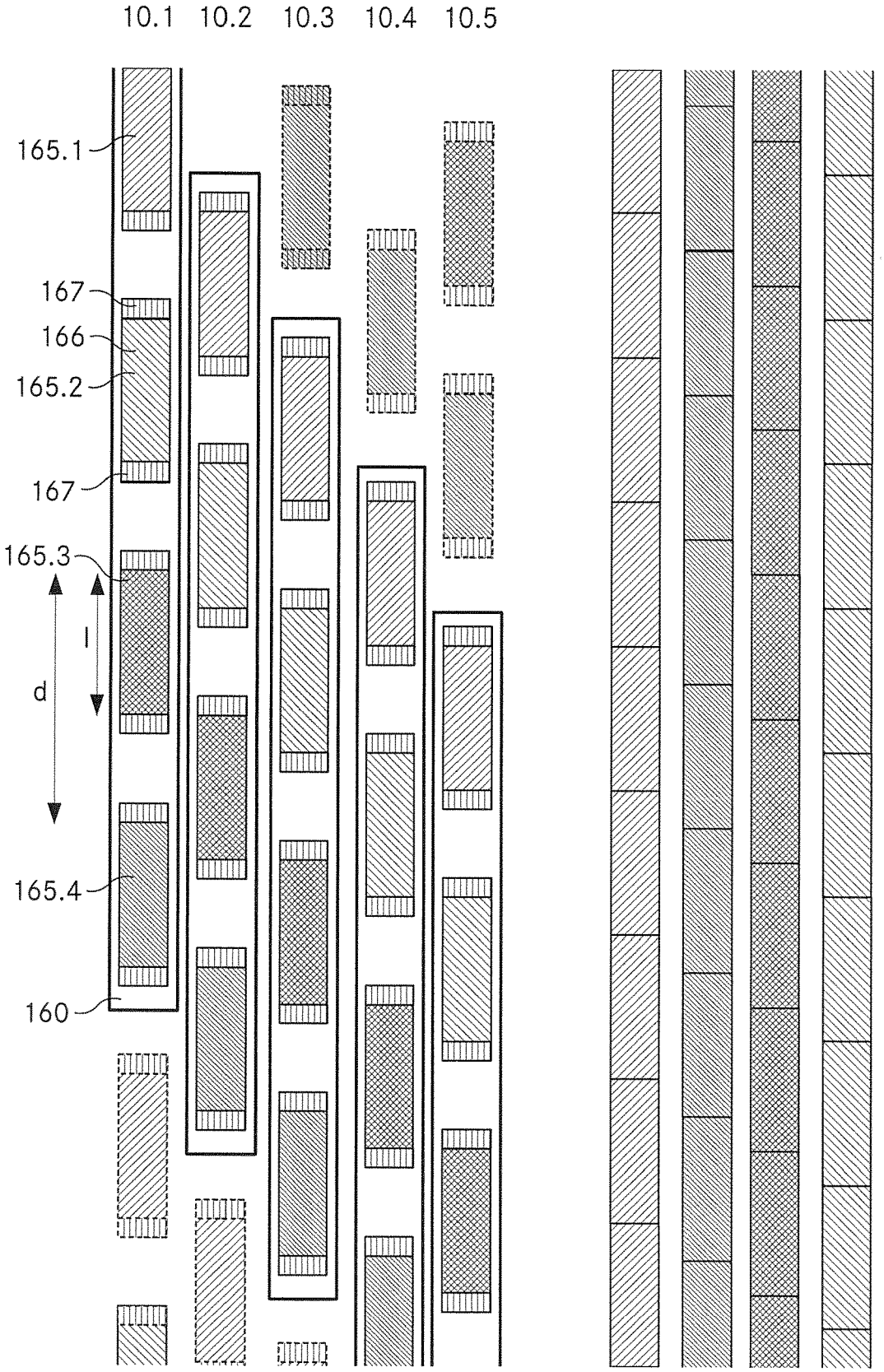
FIG. 9 a schematic representation of the print engine position in scans of subsequent printing bands and of the resulting colour bands.

The FIG. 9 is a schematic representation of the print engine position in scans of subsequent printing bands and of the resulting colour bands.

In order to simplify the presentation, a print engine 160' having only four print bars 165.1' . . . 165.4' is shown. The generalization to other numbers of print bars (e. g. 8) is straightforward.

The left hand side of FIG. 9 shows the position of the print engine 160' with respect to the substrate 1 in scans of five subsequent printing bands 10.1 . . . 10.5. To facilitate the presentation, the position of the substrate 1 is fixed, whereas the position of the print engine 160' is moved from band to band. As a matter of course, in the context of the inkjet printer as shown in FIGS. 3-7, the change of relative position between print engine 160' and substrate 2 will be cause by moving the substrate 2 by means of the transport mechanism.

The print bars 165.1' . . . 165.4' are represented by their nozzle arrays. These arrays feature an active area 166 constituting a central region along the longitudinal axis of the print bar (and thus of the nozzle array) and two inactive areas 167 constituting the end regions along the longitudinal axis of the print bar. As described in more detail below, the exact position of the active area 166 may be dynamically adapted in order to compensate for positioning errors of the respective print bar with respect to the substrate 1 along the longitudinal axis. The nozzle arrays of the print bars 165.1 . . . 4' are arranged along the longitudinal axis of the print engine 160. The length l of the active area is 173.4 mm, the distance d of the start of the active areas of two neighbouring print bars is 238.4 mm. The four print bars 165.1 . . . 4' are supplied by differently coloured ink: cyan for print bar 165.1', magenta for print bar 165.2', yellow for print bar 165.3' and black for print bar 165.4'. The different colours are schematically represented in FIG. 9 by different hatchings.

The substrate is shifted in between neighbouring bands by the distance l, which corresponds to the length of the active area. This means that by subsequent bands the entire area of the substrate 1 may be printed with a certain colour. The same holds true for all colours, but the transition from one band to another will be different for each of the colours, as can be seen from the right hand side of the FIG. 9 which shows the areas printed in one band for the four colours. Combining the four colours, the transitions will be evenly distributed over the substrate, and there will be no transitions between neighbouring bands that include more than one colour.

The invention is not limited to the embodiments described above. In particular, the specific configuration of the print engines, print bars, transport system or scanning mechanism may substantially differ from the described embodiments. Nevertheless, the invention will still be applicable.

In summary, it is to be noted that the invention creates an inkjet printer that exhibits reduced susceptibility to image defects.

The invention claimed is:

1. Inkjet printer comprising a) a transport mechanism for transporting a substrate along a first axis;

b) a print engine comprising at least two inkjet print bars arranged along the first axis;

c) a controller for controlling the ejection of ink by the at least two inkjet print bars e) at least two first encoders for the determination of at least two first positions of substrate locations along the first axis;

f) a compensator that processes the at least two determined first positions to generate at least one first individual compensation parameter for each of the at least two inkjet print bars;

wherein the first compensation parameters are transmitted to the controller to influence the ejection of ink in such a way that effects due to variations of the at least two first positions of the substrate along the first axis are compensated, wherein a longitudinal extension of the at least two inkjet print bars of the print engine extends parallel to the first axis and wherein the inkjet printer comprises a scanning mechanism for moving the print engine along a second axis perpendicular to the first axis.

2. Inkjet printer as recited in claim 1, comprising at least three inkjet print bars arranged along the first axis.

3. Inkjet printer as recited in claim 1, the transport mechanism for transporting the substrate comprising a plurality of rollers supporting the substrate, the at least two first encoders being assigned to at least two of the rollers.

4. Inkjet printer as recited in claim 3, wherein the at least two of the rollers have a different circumference.

5. Inkjet printer as recited in claim 1, comprising at least two second encoders for the determination of at least two second positions of the at least two inkjet print bars along the second axis, wherein the compensator is configured to process the second positions to generate at least one second individual compensation parameter for each of the at least two inkjet print bars and wherein the second compensation parameters are transmitted to the controller to influence the ejection of ink in such a way that effects due to differences of the at least two second positions from predetermined reference positions are compensated.

6. Inkjet printer as recited in claim 1, wherein the first compensation parameters are spatial offset values and in that the controller selects ejection nozzles of the print bars to be used according to the spatial offset values.

7. Inkjet printer as recited in claim 1, wherein the second compensation parameters are temporal offset values and wherein the controller time shifts ejection of ink of one or several of the print bars according to the temporal offset values.

8. Inkjet printer as recited in claim 1, the transport mechanism comprising a plurality of rollers supporting the substrate.

9. Inkjet printer as recited in claim 8, herein an adhesive belt for attaching the substrate is supported on the plurality of rollers.

10. Inkjet printer as recited in claim 8, wherein the plurality of rollers are provided with a cooling mechanism.

11. Inkjet printer as recited in claim 1, wherein the transport mechanism for transporting the substrate comprises a plurality of rollers supporting the substrate, the at least two first encoders being assigned to at least two of the rollers, the at least two of the rollers having a circular cross-section and having chosen different diameters leading to a different circumference, the compensator taking into account during processing the different circumference for distinguishing between effects originating at the different rollers.

12. Inkjet printer comprising a) a transport mechanism for transporting a substrate along a first axis;

b) a print engine comprising at least two inkjet print bars arranged along a longitudinal axis of the print engine;

c) a scanning mechanism for moving the print engine along a second axis, the second axis being oriented perpendicular to the first axis;

d) a controller for controlling the ejection of ink by the at least two inkjet print bars;

wherein the longitudinal axis of the print engine runs parallel to the first axis, wherein each of the inkjet print bars comprises an ink nozzle array, a main extension of which extending along the longitudinal axis, wherein the main extension of the nozzle array has a length L, in that the inkjet print bars are arranged on the print engine in such a way that a longitudinal distance d between a start of the nozzle array of a first inkjet print bar and a start of a nozzle array of a second inkjet print bar, adjacent to the first inkjet print bar, is larger than the length L of the nozzle array, wherein the controller is programmed to control the transport mechanism to effect a main transport feed of length L between scans of subsequent bands, and wherein $d\ L+x$, where $x=(m/n)\ L$, where n is the number of inkjet print bars and m is an integer number, where $1<m<n$.

13. Inkjet printer as recited in claim 12, the transport mechanism comprising a plurality of rollers supporting the substrate.

14. Inkjet printer as recited in claim 13, wherein an adhesive belt for attaching the substrate is supported on the plurality of rollers.

15. Inkjet printer as recited in claim 13, wherein the plurality of rollers are provided with a cooling mechanism.

16. Inkjet printer comprising a) a transport mechanism for transporting a substrate along a first axis;

b) a print engine comprising at least two inkjet print bars arranged along the first axis;

c) a controller for controlling the ejection of ink by the at least two inkjet print bars;

c) at least two first encoders for the determination of at least two first positions of substrate locations along the first axis;

a compensator that processes the at least two determined first positions to generate at least one first individual compensation parameter for each of the at least two inkjet print bars;

wherein the first compensation parameters are transmitted to the controller to influence the ejection of ink in such a way that effects due to variations of the at least two first positions of the substrate along the first axis are compensated and wherein the transport mechanism for transporting the substrate comprises a plurality of rollers supporting the substrate, the at least two first encoders being assigned to at least two of the rollers and wherein a longitudinal extension of the at least two inkjet print bars of the print engine extends parallel to the first axis and in that the inkjet printer comprises a scanning mechanism for moving the print engine along a second axis perpendicular to the first axis, wherein the inkjet printer comprises at least two second encoders for the determination of at least two second positions of the at least two inkjet print bars along the second axis, wherein the compensator is configured to process the second positions to generate at least one second individual compensation parameter for each of the at least two inkjet print bars and wherein the second compensation parameters are transmitted to the controller to influence the ejection of ink in such a way that effects due to differences of the at least two second positions from predetermined reference positions are compensated.

* * * * *